US006814084B2

(12) United States Patent
Gueret

(10) Patent No.: US 6,814,084 B2
(45) Date of Patent: Nov. 9, 2004

(54) APPLICATION MEMBER, APPLICATOR, SYSTEM, AND METHOD

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 98 days.

(21) Appl. No.: 09/865,518

(22) Filed: May 29, 2001

(65) Prior Publication Data

US 2002/0014250 A1 Feb. 7, 2002

(30) Foreign Application Priority Data

May 26, 2000 (FR) ..... 00 06770

(51) Int. Cl.[7] ..... A45D 40/26; A45D 40/24; A66B 11/00

(52) U.S. Cl. ..... 132/218; 132/317; 401/122; 401/126

(58) Field of Search ..... 132/218, 901, 132/313, 317, 110, 137; 401/122, 126, 129; 15/206, 207, 207.2

(56) References Cited

U.S. PATENT DOCUMENTS

| | | | |
|---|---|---|---|
| 155,977 | A | 10/1874 | Rogers |
| 466,496 | A | 1/1892 | Heysinger |

(List continued on next page.)

FOREIGN PATENT DOCUMENTS

| | | |
|---|---|---|
| DE | 25 59 273 | 7/1977 |
| EP | 0 038 524 | 10/1981 |
| EP | 0 204 466 | 12/1986 |
| EP | 0 474 934 | 3/1992 |
| FR | 2 564 712 | 11/1985 |
| FR | 2 744 608 | 8/1997 |
| FR | 2 748 636 | 11/1997 |
| FR | 1 531 835 | 5/1998 |
| FR | 2 769 808 | 4/1999 |
| GB | 265 027 | 2/1927 |
| GB | 2 146 520 | 4/1985 |
| GB | 2 159 699 | 12/1985 |
| GB | 2 256 586 | 12/1992 |
| JP | 62-38580 | 10/1987 |
| JP | 7-322915 | 12/1995 |
| JP | 9-108033 | 4/1997 |
| JP | 10-215944 | 8/1998 |
| JP | 10-327929 | 12/1998 |
| WO | WO 95/17837 | 7/1995 |
| WO | WO 97/28719 | 8/1997 |
| WO | WO 01/05273 | 1/2001 |

OTHER PUBLICATIONS

English–language abstract of JP 62–38580.
English–language abstract of JP 10–327929.
Jean–Louis H. Gueret, "Applicator System and Method," U.S. patent application No. 09/813,003, filed Mar. 21, 2001.
English–language translation of FR 1531835.
Co–pending application—Title: Devices and Methods for Applying a Product to Hair Inventor(s): Jean–Louis H. Gueret U.S. Filing Date: May 29, 2001.
English language Derwent Abstract of DE 25 59 273, Jul. 7, 1977.

*Primary Examiner*—Kevin Shaver
*Assistant Examiner*—Robyn Kien Doan
(74) *Attorney, Agent, or Firm*—Finnegan, Henderson, Farabow, Garrett & Dunner, LLP

(57) ABSTRACT

An application member may comprise a first portion, a second portion, and a base portion extending between the first and second portions. The application member may also comprise at least one support element located at least partially between the first and second portions. The at least one support element may comprise a plurality of application elements for applying the product, a first part proximal to the base portion, and a second part distal from the base portion. The application member may also comprise a gap located between the base portion and the second part of the support element, wherein the gap extends along at least a part of a length of the support element.

102 Claims, 6 Drawing Sheets

U.S. PATENT DOCUMENTS

| | | | | | |
|---|---|---|---|---|---|
| 791,690 | A | | 6/1905 | Grell | |
| 1,094,013 | A | | 4/1914 | Peterson | |
| 1,580,365 | A | | 4/1926 | Bechtold | |
| 1,670,161 | A | | 5/1928 | Meyer | |
| 1,780,206 | A | | 11/1930 | McKellar | |
| 1,829,228 | A | | 10/1931 | Lewis | |
| 1,892,749 | A | | 1/1933 | Philaja | |
| 1,963,389 | A | | 6/1934 | Vardeman | |
| 1,989,185 | A | | 1/1935 | Clein | |
| 2,175,344 | A | | 10/1939 | Friedman | |
| 2,255,618 | A | | 9/1941 | Huppert | |
| 2,264,346 | A | | 12/1941 | Tupper | |
| 2,348,399 | A | | 5/1944 | Golden | |
| 2,395,002 | A | | 2/1946 | Kemmer | |
| 2,569,246 | A | | 9/1951 | Marcellus | |
| 2,596,296 | A | | 5/1952 | Shields | |
| 2,626,618 | A | | 1/1953 | Collison | |
| 2,655,925 | A | | 10/1953 | Ulvad | |
| 2,806,476 | A | | 9/1957 | Thompson | |
| 3,312,583 | A | | 4/1967 | Rochlis | |
| 3,669,130 | A | | 6/1972 | Petroczky | |
| 3,763,870 | A | | 10/1973 | Montgomery et al. | |
| 3,862,639 | A | | 1/1975 | Schefer et al. | |
| 3,892,248 | A | | 7/1975 | Kingsford | |
| 3,921,650 | A | | 11/1975 | Montgomery | |
| 3,930,280 | A | | 1/1976 | Vasas | |
| 3,998,235 | A | * | 12/1976 | Kingsford | 132/218 |
| 4,403,624 | A | | 9/1983 | Montgomery | |
| 4,422,986 | A | | 12/1983 | Cole | |
| 4,561,456 | A | | 12/1985 | Gueret | |
| 4,565,205 | A | | 1/1986 | Taylor | |
| 4,635,659 | A | | 1/1987 | Spatz | |
| 4,660,582 | A | | 4/1987 | Taylor | |
| 4,662,385 | A | * | 5/1987 | Schefer | 132/218 |
| 4,712,936 | A | | 12/1987 | Kessler | |
| 4,744,377 | A | | 5/1988 | Dolan, Jr. | |
| 4,804,004 | A | | 2/1989 | Taylor | |
| D309,799 | S | * | 8/1990 | Ouellette | D28/7 |
| 4,964,429 | A | * | 10/1990 | Cole | 132/218 |
| 5,007,442 | A | | 4/1991 | Hirzel | |
| 5,046,213 | A | | 9/1991 | Curtis et al. | |
| 5,086,793 | A | | 2/1992 | Kingsford | |
| 5,137,387 | A | | 8/1992 | Byrd et al. | |
| 5,161,554 | A | | 11/1992 | Fitjer | |
| 5,765,573 | A | | 6/1998 | Gueret | |
| 5,918,994 | A | | 7/1999 | Gueret | |
| 5,951,185 | A | | 9/1999 | Kingsford et al. | |
| 6,026,824 | A | | 2/2000 | Gueret | |
| 6,026,825 | A | | 2/2000 | De Laforcade | |
| 6,053,179 | A | | 4/2000 | Lhuisset | |
| 6,067,997 | A | | 5/2000 | Gueret | |
| 6,343,607 | B1 | | 2/2002 | Gueret | |
| 6,408,857 | B1 | * | 6/2002 | Neuner | 132/218 |
| 6,412,496 | B1 | | 7/2002 | Gueret | |
| 6,446,637 | B2 | | 9/2002 | Gueret | |
| 6,539,950 | B1 | | 4/2003 | Gueret | |
| 6,546,937 | B2 | | 4/2003 | Gueret | |
| 6,581,610 | B1 | | 6/2003 | Gueret | |

* cited by examiner

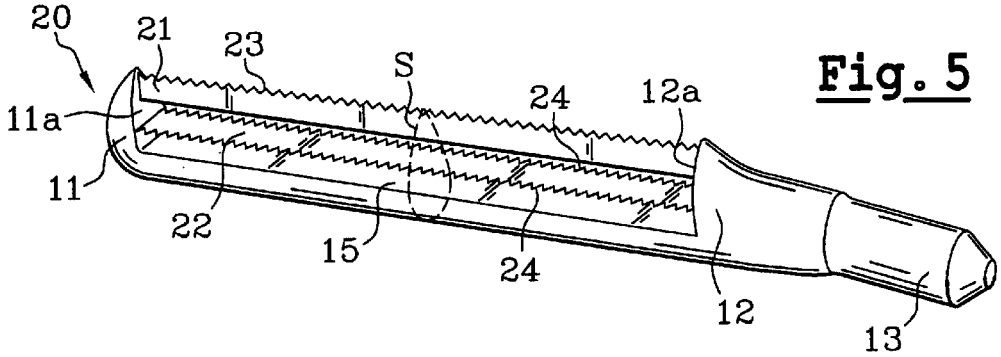
Fig. 5
Fig. 6
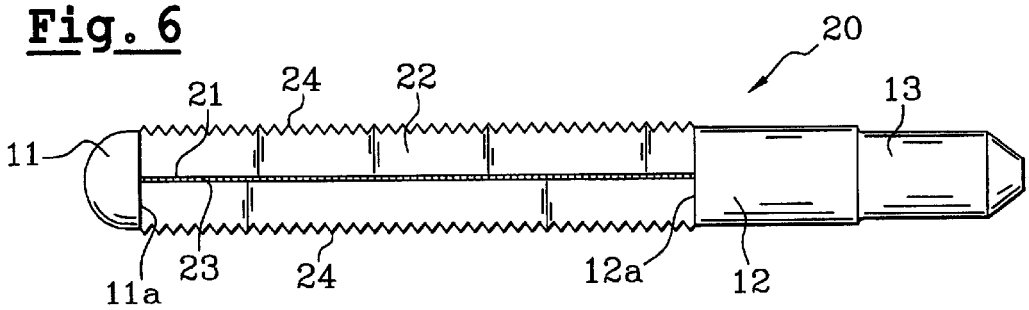
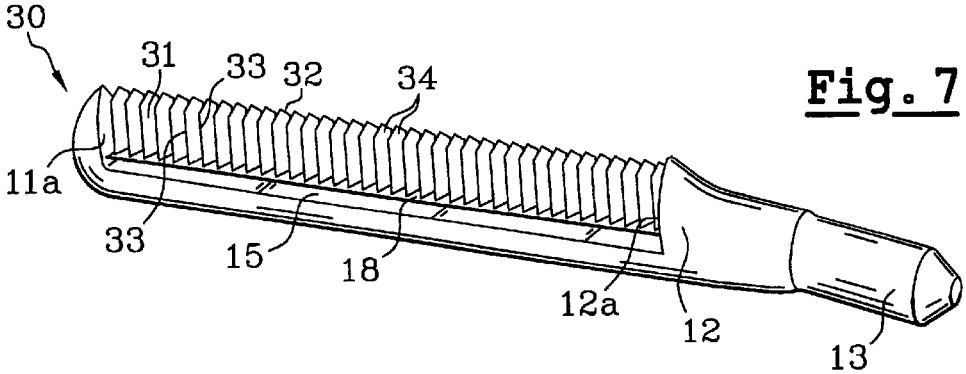
Fig. 7
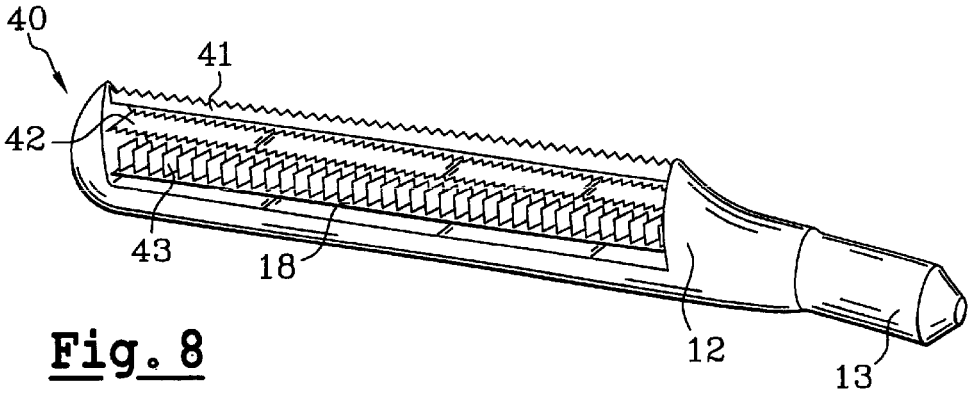
Fig. 8

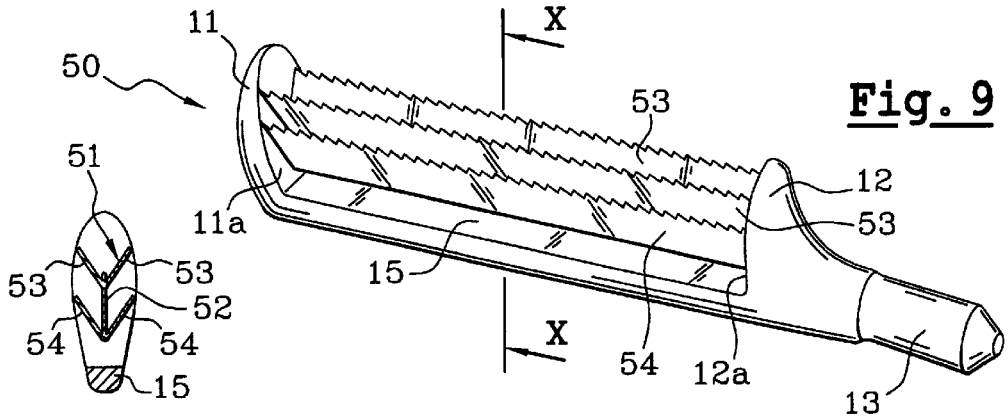
Fig. 9
Fig. 10
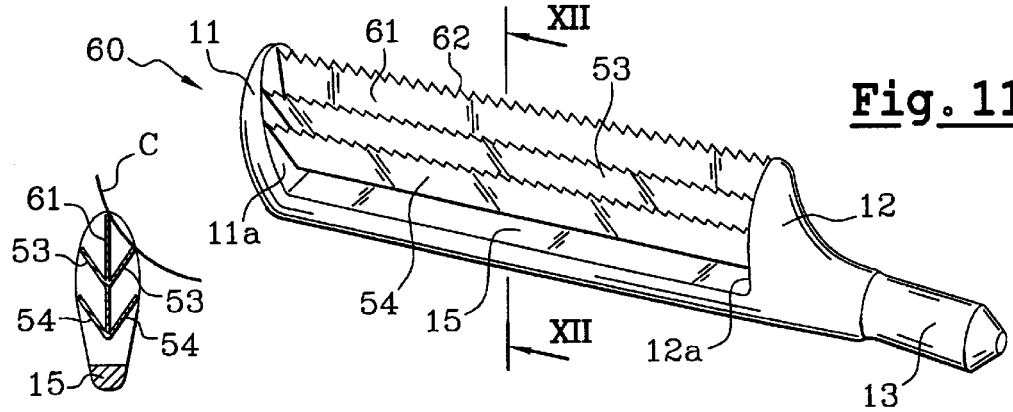
Fig. 11
Fig. 12
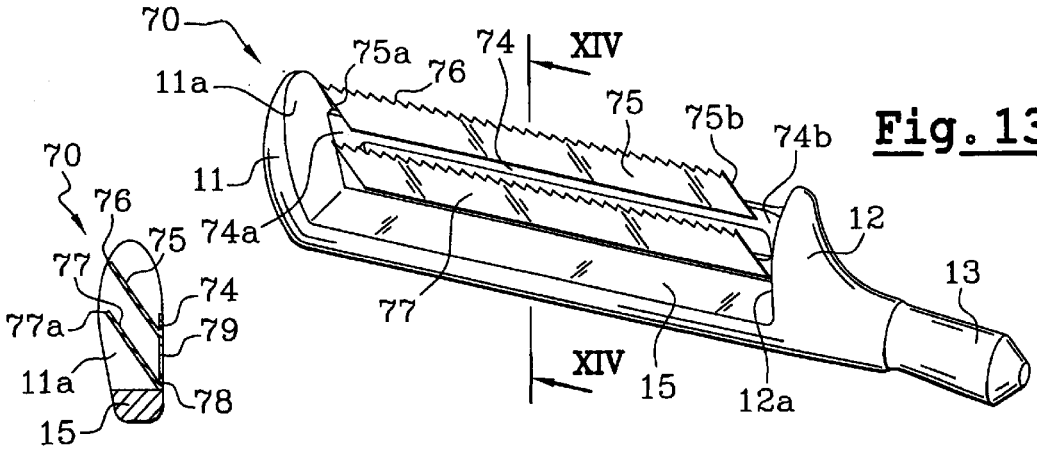
Fig. 13
Fig. 14

APPLICATION MEMBER, APPLICATOR, SYSTEM, AND METHOD

The present invention relates to a device for applying a product, for example, a cosmetic or care product, to the eyelashes, the eyebrows, or any other keratinous fibers or hairs.

Although devices of that type are generally known, there exists a need for an improved applicator capable of holding a relatively large quantity of product so as to ensure that the user does not need to refill the applicator too frequently while making up. In known applicators having a row of teeth, the quantity of product retained between the teeth depends on the spacing of the teeth. As such, the quantity of product that can be held by the applicator is limited by the fact that the teeth must remain relatively close together in order to be able to take hold of the eyelashes.

There also exists a need for an applicator that is comfortable to use and that presents a certain amount of flexibility at the moment of application.

An optional aspect of the present invention relates to an applicator capable of taking hold of hairs and/or of spreading the product on the surface thereof in a manner that is satisfactory, while being comfortable to use and allowing sufficient time between refills.

As embodied and broadly described herein, one optional aspect of the invention includes an application member for applying a product to hair. The application member may comprise a first portion, a second portion, and a base portion interconnecting the first and second portions. The application member may also comprise a plurality of application elements configured to apply the product. The plurality of application elements may be located between the first and second portions. The application member may further comprise at least one support element located between the first and second portions. The at least one support element may comprise at least some of the plurality of application elements and may be connected to the base portion over no more than a portion of a length of the support element. For example, the at least one support element may be connected to the base portion along a portion of the length of the support member or the support member may not be connected to the base portion along any portion of its length.

In an embodiment, the at least one support element may be suspended between the first and second portions of the application member so that the at least one support element does not contact the base portion.

In another embodiment, the at least one support element may comprise at least one bridge member. The at least one bridge member may connect the at least one support element to the base portion. For example, the at least one bridge member may comprise first and second bridge members, wherein the first bridge member is separated from the second bridge member by a gap.

The at least one support element may be a separate piece coupled to at least one of the first portion, the second portion, and the base portion. Alternatively, the at least one support element, the first portion, the second portion, and the base portion may be formed of a single piece, for example, by injection molding.

The at least one support element may comprise a material that is different from a material used for making at least one other part of the application member (e.g., first portion, second portion, base portion). Alternatively, the at least one support element may comprise a material different from a material used for making any other part of the application member. In an embodiment, the at least one support element may comprise an elastomer.

In still another embodiment, the at least one support element may comprise a wall having an edge that is at least one of serrated and provided with spikes. Optionally, the at least one support element is one of substantially planar and folded in shape. For example, the at least one support element may comprise a folded wall, wherein the folded wall comprises an edge that is at least one of serrated and provided with spikes.

The at least one support element may comprise a single support element or it may comprise a plurality of support elements. For example, the at least one support element may comprise a plurality of support elements defining a plurality of walls, wherein each of the walls has at least one of the application elements for applying product to hair.

In an embodiment, the at least one support element may comprise a plurality of branches defining a plurality of walls, wherein each of the walls has at least one of the application elements for applying product to hair.

Optionally, the at least one support comprises a plurality of edges configured for applying product. For example, the plurality of edges may be configured so that an eyelash can come into contact with at least two of the edges during application.

In another embodiment, the at least one support element may comprise first and second support elements. The first support element may comprise a first wall having a serrated top edge, and the second support element may comprise a second wall located between the first wall and the base portion. Optionally, the first and second walls are one of planar and folded in shape. The first and second walls may have different orientations with respect to one another. For example, the first wall may be oriented substantially perpendicular to the second wall. One of the first and second walls may comprise two opposing edges, wherein each of the opposing edges is at least one of serrated and provided with spikes.

In yet another embodiment, the at least one support element may comprise a plurality of edges. The edges may comprise at least some of the plurality of application elements for applying product, and the edges may at least partially define an envelope surface interconnecting the first and second portions of the application member and bearing thereagainst.

The first and second portions of the application member may comprise front and rear portions respectively. The front and rear portions may be shaped so as to make it easier to pass the application member through a wiper.

In an embodiment, the at least one support element may comprise a zigzag configuration. Optionally, a longitudinal axis of the at least one support element is substantially parallel to a plane defined by the base portion. For example, the at least one support element may extend on either side of a plane, and the at least one support element may comprise teeth located alternately on opposing sides of the plane.

In still another embodiment, the at least one support element may comprise a plurality of walls disposed in a flared configuration when the application member is viewed in cross-section, wherein each of the walls comprises at least one edge configured to comb hairs. Optionally, the plurality of walls are configured to enable a hair to come into contact with two adjacent edges of the walls simultaneously during application.

In a further embodiment, the at least one support element may comprise a core and a plurality of leaves supported by the core. The leaves may be oriented transversely to the core. Optionally, the leaves overlap when the application member is viewed from a side, so as to form V-shaped notches. A size of the leaves may vary along the core. A profile of the leaves may substantially correspond to an outline of an eyelid.

In an additional embodiment, the at least one support element may comprise a wall extending obliquely over the base portion.

In another embodiment, the first portion may define a first plane and the second portion may define a second plane, wherein the first and second planes are substantially parallel to one another. The base portion may define a third plane, wherein the first and second planes are optionally substantially perpendicular to the third plane.

In another aspect, the invention includes an applicator comprising an application member and a wand, wherein the application member is on an end of the wand. In one embodiment, an axis of the wand is substantially perpendicular to a plane defined by the base portion. Alternatively, the axis of the wand may be substantially parallel to a plane defined by the base portion and/or may be oriented at an angle with respect to the axis of the wand or in any other desirable manner.

In yet another aspect, the invention includes an application and packaging system including an applicator comprising an application member and a wand having first and second ends. The application member may be on the first end of the wand, and a handle member may be on the second end of the wand. The system may also comprise a receptacle for containing a product. Optionally, the system further comprises a wiper member configured to wipe excess product from the applicator and/or a hair product contained in the receptacle. The product may be, for example, mascara.

In an embodiment, the receptacle may be configured to removably receive the applicator.

In another embodiment, the handle member may provide a closure cap for the receptacle and the receptacle may be configured to removably receive the applicator.

The application member may be made of a material that is more flexible than a material of the wand.

Optionally, the application member and the wand are formed of a single piece of unitary construction.

In a further aspect, the invention includes a method of applying a product to hair. The method may comprise providing an application and packaging system with a product contained in the receptacle, loading the applicator with the product, and applying the product to the hair by moving the applicator along the hair. For example, the product may be mascara, and the applying may comprise applying the mascara to eyelashes by moving the applicator along the eyelashes.

In an embodiment, the loading may comprise placing the applicator at least partially in the receptacle and contacting the applicator with the product in the receptacle.

When the system includes the wiper member, the method may further comprise inserting the applicator in the receptacle, removing the applicator from the receptacle, and wiping the applicator on the wiper member.

In still another aspect, the invention includes an application member comprising a first portion, a second portion, and a base portion extending between the first and second portions. The application member may also comprise at least one support element located at least partially between the first and second portions. The at least one support element may comprise a plurality of application elements for applying the product, a first part proximal to the base portion, and a second part distal from the base portion. The application member may also include a gap located between the base portion and the second part of the support element, wherein the gap extends along at least a part of a length of the support element.

In an embodiment, the gap may be located between the first part of the at least one support element and the base portion.

In another embodiment, the at least one support element may comprise a first wall substantially perpendicular to a plane defined by the base portion, and the gap may comprise a slot formed in the first wall. The at least one support element may further comprise a plurality of secondary walls branching from the first wall, wherein the secondary walls may comprise at least some of the plurality of application elements.

In still another embodiment, the at least one support element may comprise a plurality of walls disposed in a V-shape configuration when the application member is viewed in cross-section, wherein each of the walls comprise at least one edge configured to comb hairs.

In an additional aspect, the invention includes an application member comprising a first portion, a second portion, and a base portion extending between the first and second portions. The application member may also comprise at least one support element located at least partially between the first and second portions. The at least one support element may comprise a bottom portion and a plurality of application elements for applying the product, wherein at least a part of the bottom portion of the at least one support element is spaced apart from the base portion.

The invention may also include an applicator member including, between the first and second portions, at least one support element comprising all or some of the elements for applying the product, and connected to the base over no more than a portion of its length. The support element can be suspended between the first and second portions so that the support element is connected to the first and second portions at its axial ends and not connected to the base portion along the length of the support element. Alternatively, the support element can also be connected to the base via bridges of material having one or more gaps between them.

The invention may make it possible to have a support element at a certain distance from the base so as to leave at least one gap in which the product can be retained in order to be applied to hairs, in particular, to eyelashes.

In addition, given the mode of fixing, the support element can present increased flexibility in the transverse direction, thus making product application more comfortable for the user.

In a particular embodiment, the support element may comprise a separate piece; in a variant, the support element may be formed integrally with the remainder of the applicator member, e.g., by injection molding.

The support element can be made out of a material that is different from that used for making the remainder of the applicator member. In particular, it is possible to make the support element out of a vulcanized or thermoplastic elastomer, while the remainder of the applicator member is made out of a rigid or semi-rigid plastic material.

In a particular embodiment, the support element has a wall with a serrated edge forming teeth for applying the product.

The support element can be generally planar or folded in shape, with a sufficiently large quantity of product being capable of becoming deposited on its main faces. The product deposited thereon may enable hairs to be coated in product while the serrated edge is used to spread the deposited product over the hairs and to lengthen them.

When the support element has a wall that is both folded and has an edge that is serrated or provided with spikes, the action of combing hairs may be enhanced.

The application member can have a plurality of support elements or a single support element having ramifications or branches, so as to define a plurality of walls optionally at different orientations, wherein each wall has at least one of the application elements for applying product to hairs. Such walls can encourage product to accumulate on the application member to enable supplies of product to be built up so as to increase the length of time it can be used between refills.

In an embodiment, the application member may have a plurality of edges for applying the product and these edges may be arranged in such a manner that a hair, in particular an eyelash, can come into contact with at least two edges during application. Under such circumstances, the combing and/or smoothing effect may be enhanced and, in addition, the application member can take firmer hold of the hairs thus making them easier to curve, where appropriate.

In a particular embodiment, the application member has two support elements, one formed by a first wall having a serrated edge and the other formed by a second wall located between the first wall and the base portion, the two walls being planar or folded and having different orientations, e.g., being substantially perpendicular. The second wall may have two opposite serrated edges.

The edges of the support element(s) for applying the product may at least partially define an envelope surface interconnecting the first and second portions of the application member and bearing thereagainst.

In a particular embodiment, the first and second portions of the application member are front and rear portions, respectively. These portions may be shaped so as to make it easier for the application member to pass through a wiper member.

In a particular embodiment, the support element extends in a zigzag configuration, thus forming teeth that can be used for separating hairs, and it can also have projecting spikes in order to catch hold of the hairs.

The support element extending in a zigzag configuration can be parallel to a plane, or alternatively it can extend on either side of a plane, e.g., forming teeth.

Still in a particular embodiment, the support element may have a plurality of walls that are disposed in a flared configuration when the application member is observed in cross-section, with each wall having at least one edge capable of combing hairs. These walls disposed in a flared configuration may be arranged in such a manner so as to enable a hair to come into contact simultaneously with two adjacent edges of the walls during application.

In a particular embodiment, the application member has a support element including a core supporting leaves that extend transversely to the core. Such leaves can be generally planar in shape and they can be perpendicular to the longitudinal axis of the core or they can be at an acute angle thereto. The leaves can overlap when the application member is seen from the side so as to form V-notches enabling eyelashes to be taken hold of and curved. The leaves can also be various sizes depending on their position along the core, so as to give the application member a profile that matches the outline of an eyelid, for example.

In a particular embodiment, the application member has a wall extending obliquely over the base portion.

The application member can have a plurality of rows of teeth or spikes that are axially offset relative to one another. These rows of teeth or spikes can be carried by the support element(s).

The application member can also have a gap between the base portion and the support element or one of the support elements.

The invention may also include a packaging and applicator device comprising a receptacle containing a product, a wiper member, and an applicator. The applicator may comprise a wand having a handle member at one end and an applicator member at another end. The handle member may provide a closure cap for the receptacle.

The application member can be at an angle to the wand. It can be made out of a material that is more flexible than the material from which the wand is made so as to be more comfortable to use, and it can be fixed to the wand by heat-sealing, adhesive, or deforming the wand, for example. It could also be made integrally with the wand.

It is to be understood that both the foregoing description and the following description are exemplary.

The accompanying drawings are incorporated in and constitute a part of this specification. The drawings illustrate optional embodiments of the invention and, together with the description, serve to explain certain principles.

In the drawings,

FIG. 5 is a diagrammatic perspective view of a third embodiment of an application member;

FIG. 6 is a plan view of the application member of FIG. 5;

FIG. 7 is a diagrammatic perspective view of a fourth embodiment of an application member;

FIG. 8 is a diagrammatic perspective view of a fifth embodiment of an application member;

FIG. 9 is a diagrammatic perspective view of a sixth embodiment of an application member;

FIG. 10 is a view of a cross-section taken along line X—X of FIG. 9;

FIG. 11 is a diagrammatic perspective view of a seventh embodiment of an application member;

FIG. 12 is a view of a cross-section taken along line XII—XII of FIG. 11;

FIG. 13 is a diagrammatic perspective view of an eighth embodiment of an application member;

FIG. 14 is a view of a cross-section taken along line XIV—XIV of FIG. 13;

Reference will now be made in detail to optional embodiments of the invention, examples of which are illustrated in the accompanying drawings. Wherever possible, the same reference numbers are used in the drawings and the description to refer to the same or like parts.

Figure 1:
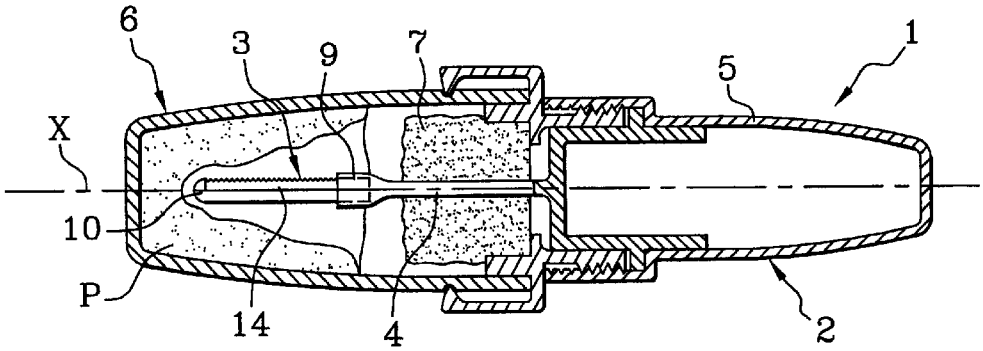
FIG. 1 is a diagrammatic axial section view of an embodiment of an application and packaging system.

FIG. 1 shows an application and packaging system 1 comprising an applicator 2 having a wand 4 provided at one end with an application member 3 and at its other end with a handle member 5. The system 1 may also comprise a receptacle 6 for containing a product P, e.g., mascara. The receptacle 6 may be provided with a wiper member 7 for wiping the application member 3, for example, while the application member 3 is being removed from the receptacle 6. Optionally, the handle member 5 may provide a cap for closing the receptacle 6.

Figure 2:
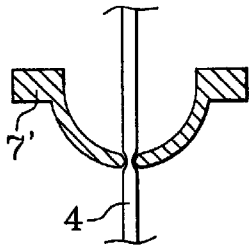
FIG. 2 is a view of an embodiment of a wiper member.

In the embodiment shown in FIG. 1, the wiper member 7 may comprise a block of open-celled foam or other appropriate material. However, a wiper member of any particular type could be used. For example, the wiper member 7 could be replaced by a wiper lip 7' of elastomer, as shown in FIG. 2. The lip 7' can optionally be flocked.

In an embodiment, the wand 4 may have a narrow region that takes up a position in register with the edges of the lip 7' when the applicator is in place inside the receptacle so as to avoid unduly compressing the wiper lip 7'.

Figure 3:
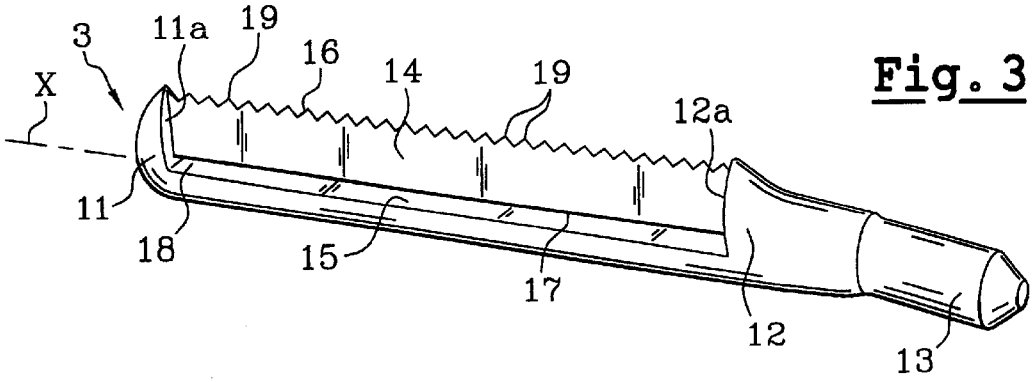
FIG. 3 is a diagrammatic perspective view of a first embodiment of an application member.

Referring to the embodiment of FIG. 3, the application member 3 may comprise a base portion 15 of generally elongate shape along a longitudinal axis X extending between a front portion 11 and a rear portion 12 of the application member 3. The axis X optionally coincides with an axis of the wand 4. Alternatively, the axis X could be at an angle with the axis of the wand 4 so as to obtain an applicator that is more ergonomic. The front and rear portions 11 and 12 may be shaped so as to make them easier to pass through the wiper member 7.

The base portion 15 may be rigid or semi-rigid and may be off-center with respect to the front and rear portions 11 and 12, wherein the front and rear portions 11 and 12 extend only from the top side of the base portion 15.

The front and rear portions 11 and 12 may have respective faces 11*a* and 12*a* that are substantially planar, mutually parallel, and/or perpendicular to the axis X.

At an end of the application member 3 remote from the front portion 11, the application member 3 may have an end piece 13 for insertion in a housing 9 formed at one end of the wand 4.

Over the base portion 15 and between the front and rear portions 11 and 12, the application member 3 may have a suspended support element. For example, the application member may comprise a plane wall 14 having a serrated edge 16 on a side facing away from the base portion 15 (e.g., distal part). The bottom edge 17 (e.g., proximal part) opposite from the serrated edge 16 may be free and may leave a rectangular gap 18 relative to the base portion 15.

The thickness of the wall 14 may be considerably smaller than that of the base portion 15, so the wall 14 presents a certain amount of flexibility in the transverse direction, i.e., the direction in which the application member 3 may be moved over the eyelashes in use. Optionally, the wall 14 may be connected over its full height to each of the faces 11*a* and 12*a*.

The serrated edge 16 may form a relatively large number of teeth 19, e.g., from about 20 to about 50, with the bottoms of the notches formed between the teeth 19 being optionally located at a non-zero distance from the edge 17. Product can therefore accumulate on both faces of the wall 14.

Figure 4:
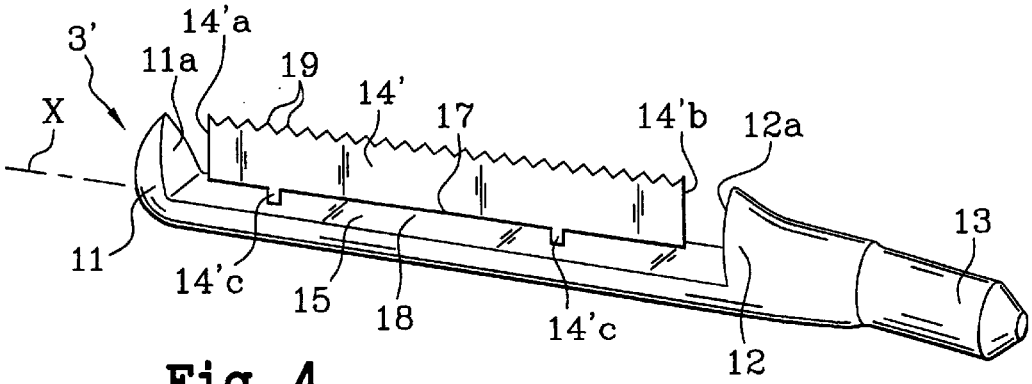
FIG. 4 is a diagrammatic perspective view of a second embodiment of an application member.

FIG. 4 shows an application member 3' that differs from the application member 3 described above in that the wall 14 is replaced by a shorter wall 14' whose axial ends 14'*a* and 14'*b* may not be connected to the front and rear portions 11 and 12. The application member 3' also differs in that the wall 14' may be connected to the base portion 15 by bridges of material 14'*c*. Because the application member 3' may not be fixed to the front and rear portions 11 and 12, the wall 14' of the application member 3' may be more flexible in the transverse direction than the wall 14.

FIGS. 5 and 6 show an application member 20 that differs from the above-described application member 3 in that the application member 20 may have two suspended support elements connected to the faces 11*a* and 12*a* of the front and rear portions 11 and 12. The first support element may be formed by a first plane wall 21 having a serrated top edge 23, and the second support element may be formed by a second plane wall 22 having two opposite side edges 24, both of which are serrated. The second plane wall 22 may be located between the first plane wall 21 and the base portion 15.

The plane of the wall 21 is shown substantially vertical in FIG. 5, as are the planes of the front and rear portions 11 and 12 of the application member 20, while the plane of the wall 22 is shown substantially perpendicular to the wall 21. The walls 21 and 22 and the front and rear portions 11 and 12, however, could have other orientations.

The serrated top edge 23 may at least partially define an envelope surface S interconnecting the front and rear portions 11 and 12 and bearing against them. The same optionally applies to the serrated edges 24 of the wall 22.

FIG. 7 shows an application member 30 that differs from the above-described application members 3 and 20 in that the application member 30 may have a suspended support element formed by a folded wall 31 connected to the faces 11 a and 12*a* and including a serrated edge 32 facing away from the base portion 15. The fold lines 33 of the wall 31 may include alternating ridges and furrows of notches formed between the teeth 34 defined by the serrated edge 32. The presence of the folds may enhance the combing action on the eyelashes in use. The folds may also increase the area of the support element and thus the quantity of product that can be taken up or held thereby.

FIG. 8 shows an application member 40 that differs from those described above in that it may have three suspended support elements 41, 42, and 43 respectively formed by a vertical plane wall similar to above-described wall 21, a horizontal wall similar to above-described wall 22, and a folded wall similar to above-described wall 31. The embodiment of FIG. 8 is schematic and is intended to illustrate the fact that the application member can have elements for application purposes that are varied to optionally provide a combination of differing effects.

FIGS. 9 and 10 show an application member 50 having a base portion 15 as described above and a suspended support element 51 comprising a central wall 52 and on both sides of the central wall 52 respective top and bottom walls 53 and 54. A cross-section of the application member 50 may present a generally flared or V-shape configuration, as shown in FIG. 10. The support element 51 may be capable of containing a relatively large quantity of product between the various walls forming the support element 51, thereby making it easier to apply product to the eyelashes and increasing the time the applicator can be used between refills.

The product can be deposited on the eyelashes and spread along them by various serrated edges.

FIGS. 11 and 12 show an application member 60 that differs from the above-described application member 50 in that the central wall 52 may be extended between the top walls 53 by a wall 61 whose top edge 62 is serrated. Product can accumulate between the walls 61 and 53 and between the walls 53 and 54 as in the above-described embodiment. An eyelash C may pick up product by contacting the product retained between the walls 61 and 53 without giving rise to excess product on the eyelash, because the eyelash may pass between the teeth of the serrated edges of the walls 61 and 53, as shown in FIG. 12.

FIGS. 13 and 14 show an application member 70 that may include a suspended support element 71 including a bar 74 with two axial ends 74*a* and 74*b* connected to the faces 11 a and 12*a* respectively, and a wall 75 presenting a serrated free edge 76 with axial ends 75*a* and 75*b* that are free. Between the wall 75 and the base portion 15, the application member 70 may have a second wall 77 parallel to the wall 75. The bar 74 corresponds to the top portion of a vertical wall 78 having a central gap (or slot) 79 that extends over practically its entire length. The wall 78 may be connected via axial ends to the faces 11 a and 12*a* and via its bottom side to the base portion 15. The wall 77 may be connected to the foot of the wall 78. The walls 75 and 77 may extend obliquely relative to the wall 78, and may have free edges 76 and 77*a* located substantially level with an outline of the front portion 11 when the application member is observed in cross-section, as in FIG. 14.

In the embodiment of FIGS. 1 to 14, the base portion 15 is shown interconnecting the front and rear portions of the support in an off-center configuration with respect to the first and second portions.

Figure 15:
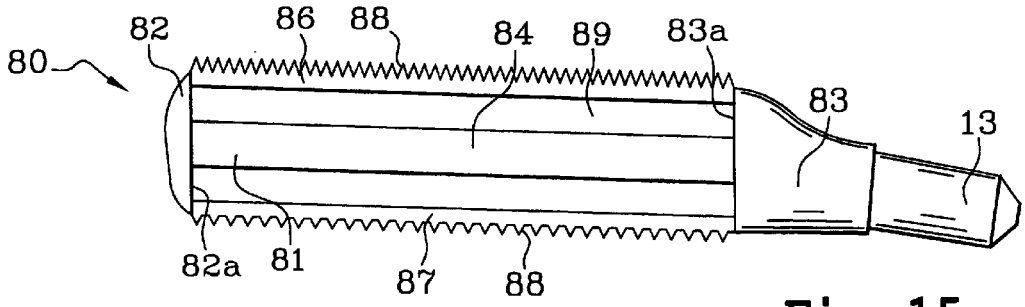
FIG. 15 is a diagrammatic perspective view of a ninth embodiment of an application member.

FIG. 15 shows an application member 80 comprising a part 81 having front and rear portions 82 and 83 that are interconnected by a link portion or base portion 84 that is optionally located substantially on the center of the front and rear portions 82, 83. The front and rear portions 82 and 83 may have respective parallel faces 82*a* and 83*a* and the application member may comprise a first support 86 and a second support 87 extending between the faces 82*a*, 83*a*. The supports 86, 87 may be diametrically opposite about the link portion 84 and may be provided on their outside edges with teeth 88. Product can accumulate in the annular gap 89 around the base portion 84 for the purpose of applying product onto the eyelashes.

Figure 16:
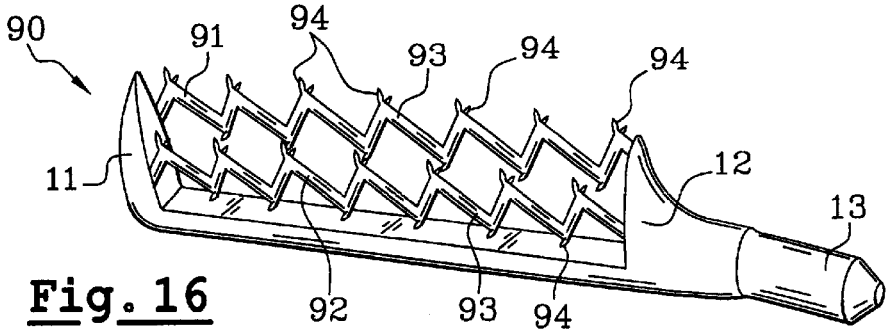
FIG. 16 is a diagrammatic perspective view of a tenth embodiment of an application member.

FIG. 16 shows an application member 90 including two suspended support elements 91 and 92. Each of the support elements 91 and 92 may comprise a wall 93 having a zigzag configuration in a vertical plane and optional spikes 94 projecting from the plane for the purpose of enabling the spreading of product onto the eyelashes. The two support elements 91 and 92 may lie in planes that are spaced apart.

Figure 17:
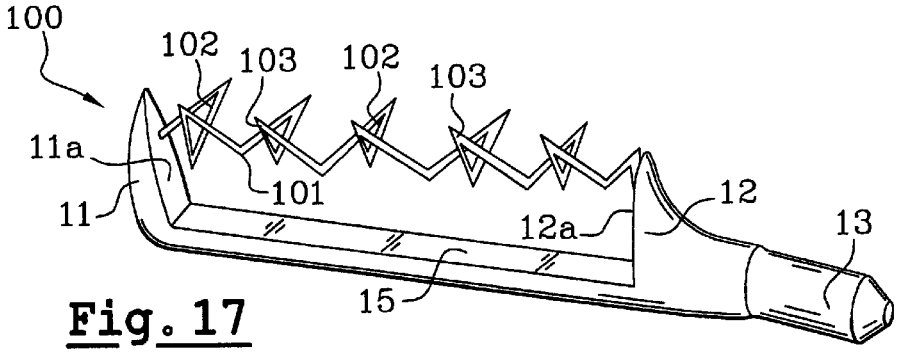
FIG. 17 is a diagrammatic perspective view of an eleventh embodiment of an application member.

FIG. 17 shows an application member 100 that differs from the above-described application member 90 in that the suspended support elements 91 and 92 are replaced by a suspended support element 101, which may have a zigzag configuration, forming teeth 102 and 103 that are located on alternate sides of a mid-plane of symmetry of the support.

Figure 18:
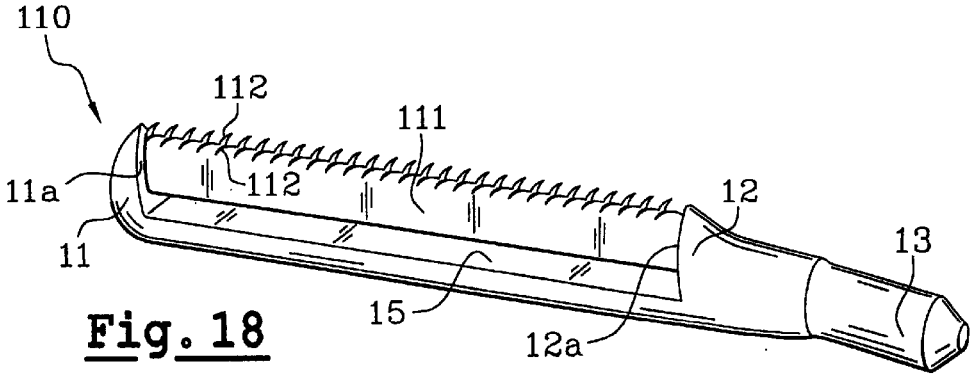
FIG. 18 is a diagrammatic perspective view of a twelfth embodiment of an application member.

FIG. 18 shows an application member 110 that differs from the application member 3 of FIG. 3 in that the teeth 19 of the wall 14 are replaced by teeth 112, which are optionally curved outwards alternately to either side of the wall 111 from which they extend.

Figure 19:
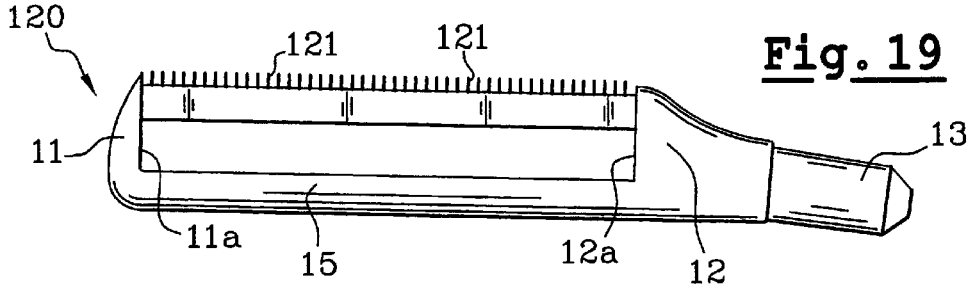
FIG. 19 is a diagrammatic perspective view of a thirteenth embodiment of an application member.

FIG. 19 shows an application member 120 that differs from the application member 3 of FIG. 3 in that the teeth 19 are replaced by spikes 121.

Figure 20:
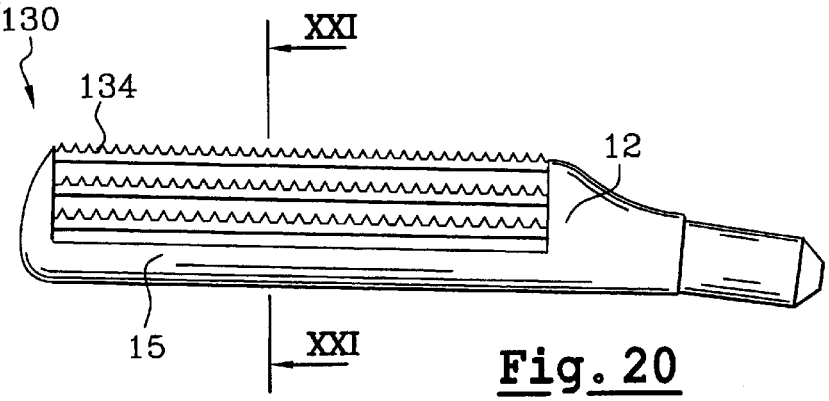
FIG. 20 is a diagrammatic perspective view of a fourteenth embodiment of an application member.
Figure 21:
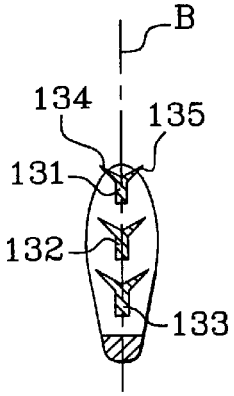
FIG. 21 is a view of a cross-section taken along line XXI—XXI of FIG. 20.

FIGS. 20 and 21 show an application member 130 that has three support elements superposed. The three support elements comprise a top element 131, an intermediate element 132, and a bottom element 133. Each of the suspended support elements 131, 132, 133 is optionally provided with two rows of lateral teeth 134 and 135 extending respectively on either side of a midplane of symmetry B of the base portion 15. The rows of teeth 134 and 135 carried by support elements 131, 132, 133 can be superposed when the application member is seen from the side, as shown in FIG. 20, or they can be offset so as to constitute V-notches between one another when the application member is seen from the side, thus enabling them to take hold of eyelashes in an effective manner.

The teeth on the intermediate and bottom support elements 132 and 133 in the embodiment of FIGS. 20 and 21 may be larger in size than the teeth formed on the top support element 131 so as to make it easier for an eyelash to come into contact with the teeth of a plurality of support elements during application.

Figure 22:
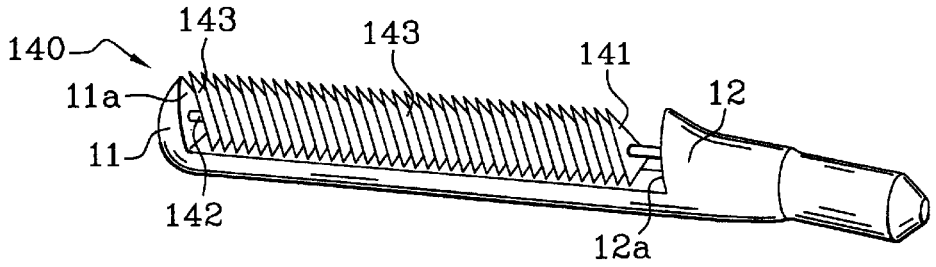
FIG. 22 is a diagrammatic perspective view of a fifteenth embodiment of an application member.

FIG. 22 shows an application member 140 that includes a support element 141 having a core 142 whose axial ends are connected to the faces 11*a* and 12*a*. The core 142 may support a plurality of leaves 143. The leaves 143 may be generally planar in shape and may be oriented perpendicularly to the longitudinal axis of the core 142. The leaves 143 may be substantially identical and parallel to one another. The leaves 143 may be spaced apart in such a manner as to allow an eyelash to pass between them while coming into contact with faces of the leaves, which then apply friction to the eyelashes so as to take hold of them.

Figure 23:
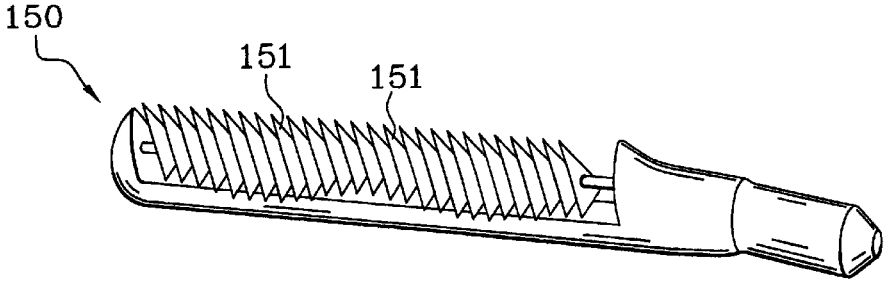
FIG. 23 is a diagrammatic perspective view of a sixteenth embodiment of an application member.

As shown in FIG. 23, the leaves can have different configurations and can vary in size as a function of location between the front and rear portions 11 and 12. For example, the application member 150 shown in FIG. 23 includes leaves oriented obliquely relative to the axis of the core so as to form V-notches 151 when the application member is seen from the side.

Figure 24:
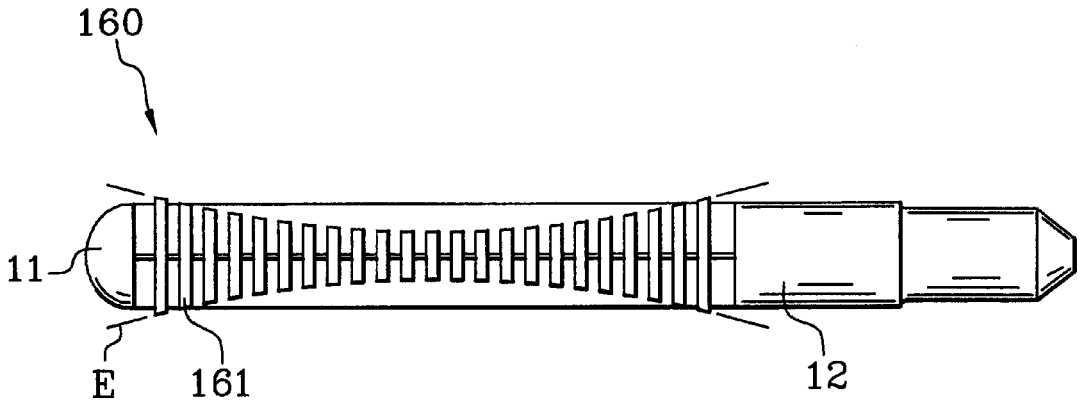
FIG. 24 is a diagrammatic perspective view of a seventeenth embodiment of an application member.

As illustrated by the application member 160 shown in FIG. 24, the size of the leaves can decrease and then increase from the front portion 11 to the rear portion 12. The leaves 161 of the application member 160 may define an envelope surface E, which is outwardly-concave on each side of the application member 160, e.g., so as to match the outline of an eyelid.

The invention is not limited to the embodiments described above. For example, an application member can be made with one or more support elements used for application purposes that present still further configurations.

Figure 25:
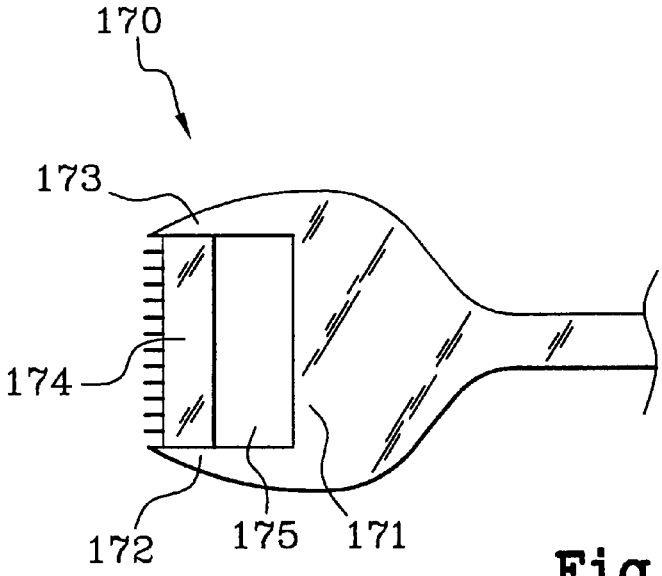
FIG. 25 is a diagrammatic perspective view of an eighteenth embodiment of an application member.

The support element(s) can be oriented transversely to the axis of the wand of the applicator. As shown in FIG. 25, the application member 170 has two lateral end portions 172 and 173 interconnected by a base portion 171 and, between its end portions 172, 173, it has a suspended support element 174 leaving a gap 175 relative to the base portion 171.

The support element(s) can be flocked and can be made of a plastic material containing a filler for improving sliding over hairs.

In the embodiments described above, the teeth can be replaced by spikes. When the application member has two or more rows of teeth or spikes, the teeth or spikes of the rows can be offset axially, e.g., in a staggered configuration, so as to take hold of eyelashes better.

It will be apparent to those skilled in the art that various modifications and variations can be made to the structure and methodology of the present invention. Thus, it should be understood that the invention is not limited to the embodiments and examples discussed in the specification. Rather, the present invention is intended to cover modifications and variations.

What is claimed is:

1. An application member for applying a product to hair, the application member comprising:

a first portion;

a second portion;

a base portion interconnecting the first and second portions;

a plurality of application elements configured to apply the product, the plurality of application elements being located between the first and second portions; and at least one support element located between the first and second portions, the at least one support element comprising at least some of the plurality of application elements and being connected to the base portion over no more than a portion of a length of the support element, wherein the at least one support element is fixed with respect to the first portion, the second portion, and the base portion; and wherein the application member comprises at least one through hole when viewed from a side thereof.

2. An application member for applying a product to hair, the application member comprising:

a first portion;

a second portion;

a base portion interconnecting the first and second portions;

a plurality of application elements configured to apply the product, the plurality of application elements being located between the first and second portions; and at least one support element located between the first and second portions, the at least one support element comprising at least some of the plurality of application elements and being connected to the base portion over no more than a portion of a length of the support element, wherein the at least one support element comprises at least one bridge member, the at least one bridge member connecting the at least one support element to the base portion; and wherein the application member comprises at least one through hole when viewed from a side thereof.

3. The application member of claim 2, wherein the at least one bridge member comprises first and second bridge members, the first bridge member being separated from the second bridge member by a gap.

4. An application member for applying a product to hair, the application member comprising:

a first portion;

a second portion;

a base portion interconnecting the first and second portions;

a plurality of application elements configured to apply the product, the plurality of application elements being located between the first and second portions; and at least one support element located between the first and second portions, the at least one support element comprising at least some of the plurality of application elements and being connected to the base portion over no more than a portion of a length of the support element, wherein the at least one support element, the first portion, the second portion, and the base portion are formed of a single piece; and wherein the application member comprises at least one through hole when viewed from a side thereof.

5. The application member of claim 4, wherein the single piece is formed by injection molding.

6. An application member for applying a product to hair, the application member comprising:

a first portion;

a second portion;

a base portion interconnecting the first and second portions;

a plurality of application elements configured to apply the product, the plurality of application elements being located between the first and second portions; and at least one support element located between the first and second portions, the at least one support element comprising at least some of the plurality of application elements and being connected to the base portion over no more than a portion of a length of the support element, wherein the at least one support element is one of substantially planar and folded in shape; and wherein the application member comprises at least one through hole when viewed from a side thereof.

7. The application member of claim 6, wherein the at least one support element comprises a folded wall, the folded wall comprising an edge that is at least one of serrated and provided with spikes.

8. An applicator comprising:

an application member for applying a product to hair, the application member comprising:

a first portion;

a second portion;

a base portion interconnecting the first and second portions;

a plurality of application elements configured to apply the product, the plurality of application elements being located between the first and second portions; and at least one support element located between the first and second portions, the at least one support element comprising at least some of the plurality of application elements and being connected to the base portion over no more than a portion of a length of the support element, wherein the at least one support element is fixed with respect to the first portion, the second portion, and the base portion; and a wand, the application member being on an end of the wand.

9. The applicator of claim 8, wherein an axis of the wand is substantially perpendicular to a plane defined by the base portion.

10. The applicator of claim 8, wherein an axis of the wand is substantially parallel to a plane defined by the base portion.

11. An application and packaging system, comprising an applicator comprising an application member for applying a product to hair, the application member comprising:

a first portion;

a second portion;

a base portion interconnecting the first and second portions;

a plurality of application elements configured to apply the product, the plurality of application elements being located between the first and second portions; and at least one support element located between the first and second portions, the at least one support element comprising at least some of the plurality of application elements and being connected to the base portion over no more than a portion of a length of the support element, wherein the at least one support element is fixed with respect to the first portion, the second portion, and the base portion, a wand having first and second ends, the application member being on the first end of the wand, and a handle member on the second end of the wand; and a receptacle for containing a product.

12. The system of claim 11, further comprising a wiper member configured to wipe excess product from the applicator.

13. A method of applying a product to hair, the method comprising:

providing the system of claim 12, the receptacle containing a hair product;

inserting the applicator in the receptacle;

loading the applicator with the product;

removing the applicator from the receptacle;

wiping the applicator on the wiper member; and applying the product to the hair by moving the applicator along the hair.

14. The system of claim 11, further comprising a hair product contacted in the receptacle.

15. The system of claim 14, wherein the product is mascara.

16. A method of applying a product to hair, the method comprising:

providing the system of claim 14;

loading the applicator with the product; and applying the product to the hair by moving the applicator along the hair.

17. The method of claim 16, wherein the product is mascara, and wherein the applying comprises applying the mascara to eyelashes by moving the applicator along the eyelashes.

18. The method of claim 16, wherein the loading comprises placing the applicator at least partially in the receptacle and contacting the applicator with the product in the receptacle.

19. The system of claim 11, wherein the receptacle is configured to removably receive the applicator.

20. The system of claim 11, wherein the handle member provides a closure cap for the receptacle and the receptacle is configured to removably receive the applicator.

21. The system of claim 11, wherein the application member is made of a material that is more flexible than a material of the wand.

22. The system of claim 11, wherein the application member and the wand are formed of a single piece of unitary construction.

23. An application member for applying a product to hair, the application member comprising:

a first portion;

a second portion;

a base portion extending between the first and second portions;

at least one support element located at least partially between the first and second portions, the at least one support element comprising a plurality of application elements for applying the product, a first part proximal to the base portion, and a second part distal from the base portion; and a gap located between the base portion and the second part of the support element, the gap extending along at least a part of a length of the support element, wherein the at least one support element is fixed with respect to the first portion, the second portion, and the base portion; and wherein the application member comprises at least one through hole when viewed from a side thereof.

24. The application member of claim 23, wherein the gap is located between the first part of the at least one support element and the base portion.

25. The application member of claim 23, wherein the at least one support element comprises a first wall substantially perpendicular to a plane defined by the base portion, and wherein the gap comprises a slot formed in the first wall.

26. The application member of claim 25, wherein the at least one support element further comprises a plurality of secondary walls branching from the first wall, the secondary walls comprising at least some of the plurality of application elements.

27. The application member of claim 23, wherein the at least one support element comprises a folded wall.

28. The application member of claim 27, wherein the folded wall comprises an edge that is at least one of serrated and provided with spikes.

29. The application member of claim 23, wherein the at least one support element comprises a plurality of support elements defining a plurality of walls, each of the walls having at least one of the application elements for applying the product to hair.

30. The application member of claim 23, wherein the at least one support element comprises a plurality of branches defining a plurality of walls, each of the walls having at least one of the application elements for applying the product to hair.

31. The application member of claim 23, wherein the at least one support element comprises a plurality of edges configured for applying product.

32. The application member of claim 31, wherein the plurality of edges are configured so that an eyelash can come into contact with at least two of the edges during product application.

33. The application member of claim 23, wherein the at least one support element comprises first and second support elements, and wherein the first support element comprises a first wall having a serrated top edge, and the second support element comprises a second wall located between the first wall and the base portion.

34. The application member of claim 33, wherein the first and second walls are one of planar and folded in shape.

35. The application member of claim 34, wherein the first wall is oriented substantially perpendicular to the second wall.

36. The application member of claim 33, wherein one of the first and second walls comprises two opposing edges, each of the opposing edges being at least one of serrated and provided with spikes.

37. The application member of claim 23, wherein the at least one support element comprises a plurality of edges, the edges comprising at least some of the plurality of application elements for applying the product, and wherein the edges at least partially define an envelope surface between the first and second portions of the application member.

38. The application member of claim 23, wherein the at least one support element comprises at least a portion configured in a zigzag shape.

39. The application member of claim 38, wherein the at least one support element extends on either side of a plane, the at least one support element comprising teeth located alternately on opposing sides of the plane.

40. The application member of claim 23, wherein the at least one support element comprises a plurality of walls disposed in a V-shape configuration when the application member is viewed in cross-section, each of the walls comprising at least one edge configured to comb hairs.

41. The application member of claim 40, wherein the plurality of walls are configured to enable a hair to come into contact with two adjacent edges of the walls simultaneously during application.

42. The application member of claim 23, wherein the at least one support element comprises a core and a plurality of leaves supported by the core, the leaves being transverse to the core.

43. The application member of claim 42, wherein the leaves overlap when the application member is viewed from a side, so as to form V-shaped notches.

44. The application member of claim 42, wherein a size of the leaves varies along a length of the core.

45. The application member of claim 42, wherein a profile of the leaves substantially corresponds to an outline of an eyelid.

46. The application member of claim 23, wherein the at least one support element comprises a wall not substantially perpendicular to a plane defined by the base portion.

47. The application member of claim 23, wherein the first portion defines a first plane and the second portion defines a second plane, the first and second planes being substantially parallel to one another.

48. The application member of claim 47, wherein the base portion defines a third plane, the first and second planes being substantially perpendicular to the third plane.

49. An application member for applying a product to hair, the application member comprising:

a first portion;

a second portion;

a base portion extending between the first and second portions;

at least one support element located at least partially between the first and second portions, the at least one support element comprising a plurality of application elements for applying the product, a first part proximal to the base portion, and a second part distal from the base portion; and a gap located between the base portion and the second part of the support element, the gap extending along at least a part of a length of the support element, wherein the at least one support element is suspended between the first and second portions of the application member, and wherein the gap extends along the entire length of the support element so that the first part does not contact the base portion.

50. An application member for applying a product to hair, application member comprising:

a first portion;

a second portion;

a base portion extending between the first and second portions;

at least one support element located at least partially between the first and second portions, the at least one support element comprising a plurality of application elements for applying the product, a first part proximal to the base portion, and a second part distal from the base portion; and a gap located between the base portion and the second part of the support element, the gap extending along at least a part of a length of the support element, wherein the at least one support element comprises at least one bridge member, the at least one bridge member connecting the at least one support element to the base and portion;

wherein the application member comprises at least one through hole when viewed from a side thereof.

51. The application member of claim 50, wherein the at least one bridge member comprises first and second bridge members, the first and second bridge members being separated from one another and defining a portion of the gap.

52. An applicator comprising:

an application member for applying a product to hair, the application member comprising:

a first portion;

a second portion;

a base portion extending between the first and second portions;

at least one support element located at least partially between the first and second portions, the at least one support element comprising a plurality of application elements for applying the product, a first part proximal to the base portion, and a second part distal from the base portion; and a gap located between the base portion and the second part of the support element, the gap extending along at least a part of a length of the support element, wherein the at least one support element is fixed with respect to the first portion, the second portion, and the base portion; and a wand, the application member being on an end of the wand.

53. The applicator of claim 50, wherein an axis of the wand is substantially perpendicular to a plane defined by the base portion.

54. The applicator of claim 50, wherein an axis of the wand is substantially parallel to a plane defined by the base portion.

55. An application and packaging system, comprising an applicator comprising an application member for applying a product to hair, the application member comprising:

a first portion;

a second portion;

a base portion extending between the first and second portions;

at least one support element located at least partially between the first and second portions, the at least one support element comprising a plurality of application elements for applying the product, a first part proximal to the base portion, and a second part distal from the base portion; and a gap located between the base portion and the second part of the support element, the gap extending along at least a part of a length of the support element, wherein the at least one support element is fixed with respect to the first portion, the second portion, and the base portion, a wand having first and second ends, the application member being on the first end of the wand, and a handle member on the second end of the wand; and a receptacle for containing a product.

56. The system of claim 55, further comprising a wiper member configured to wipe excess product from the applicator.

57. A method of applying a product to hair, the method comprising:

providing the system of claim 56, the receptacle containing a hair product;

inserting the applicator in the receptacle;

loading the applicator with the product;

removing the applicator from the receptacle;

wiping the applicator on the wiper member; and applying the product to the hair by moving the applicator along the hair.

58. The system of claim 55, further comprising a hair product contained in the receptacle.

59. The system of claim 58, wherein the product is mascara.

60. A method of applying a product to hair, the method comprising:

providing the system of claim 58;

loading the applicator with the product; and applying the product to the hair by moving the applicator along the hair.

61. The method of claim 60, wherein the product is mascara, and wherein the applying comprises applying the mascara to eyelashes by moving the applicator along the eyelashes.

62. The method of claim 60, wherein the loading comprises placing the applicator at least partially in the receptacle and contacting the applicator with the product in the receptacle.

63. The system of claim 55, wherein the receptacle is configured to removably receive the applicator.

64. The system of claim 55, wherein the handle member provides a closure cap for the receptacle and the receptacle is configured to removably receive the applicator.

65. The system of claim 55, wherein the application member is made of a material that is more flexible than a material of the wand.

66. An application member for applying a product to hair, the application member comprising:

a first portion;

a second portion;

a base portion extending between the first and second portions; and at least one support element located at least partially between the first and second portions, the at least one support element comprising a bottom portion and a plurality of application elements for applying the product, wherein at least a part of the bottom portion of the at least one support element is spaced apart from the base portion, wherein the at least one support element is fixed with respect to the first portion, the second portion, and the base portion, and wherein the application member comprises at least one through hole when viewed from a side thereof.

67. An application member for applying a product to hair, the application member comprising:

a first portion;

a second portion;

a base portion interconnecting the first and second portions;

a plurality of application elements configured to apply the product, the plurality of application elements being located between the first and second portions; and at least one support element located between the first and second portions, the at least one support element comprising at least some of the plurality of application elements and being connected to the base portion over no more than a portion of a length of the support element, wherein the at least one support element is made of plastic, and wherein the application member comprises at least one through hole when viewed from a side thereof.

68. An application member for applying a product to hair, the application member comprising:

a first portion;

a second portion;

a base portion interconnecting the first and second portions;

a plurality of application elements configured to apply the product, the plurality of application elements being located between the first and second portions; and at least one support element located between the first and second portions, the at least one support element comprising at least some of the plurality of application elements and being connected to the base portion over no more than a portion of a length of the support element, wherein the application member comprises at least one through hole when viewed from a side thereof.

69. The application member of claim 68, wherein the at least one support element is suspended between the first and second portions of the application member so that the at least one support element does not contact the base portion.

70. The application member of claim 68, wherein the at least one support element is a separate piece coupled to at least one of the first portion, the second portion, and the base portion.

71. The application member of claim 68, wherein the at least one support element comprises a material that is different from a material used for making at least one other part of the application member.

72. The application member of claim 68, wherein the at least one support element comprises a material different from a material used for making any other part of the application member.

73. The application member of claim 68, wherein the at least support element comprises an elastomer.

74. The application member of claim 68, wherein the at least one support element comprises a wall having an edge that is at least one of serrated and provided with spikes.

75. The application member of claim 68, wherein the at least one support element comprises a plurality of support elements defining a plurality of walls, each of the walls having at least one application element for applying product to hair.

76. The application member of claim 68, wherein the at least one support element comprises a plurality of branches defining a plurality of walls, each of the walls having at least one application element for applying product to hair.

77. The application member of claim 68, wherein the at least one support element comprises a plurality of edges configured for applying product.

78. The application member of claim 77, wherein the plurality of edges are configured so that an eyelash can come into contact with at least two of the edges during product application.

79. The application member of claim 68, wherein the at least one support element comprises first and second support elements, and wherein the first support element comprises a first wall having a serrated top edge, and the second support element comprises a second wall located between the first wall and the base portion.

80. The application member of claim 79, wherein the first and second walls are one of planar and folded in shape.

81. The application member of claim 80, wherein the first and second walls have different orientations with respect to one another.

82. The application member of claim 81, wherein the first wall is oriented substantially perpendicular to the second wall.

83. The application member of claim 82, wherein one of the first and second walls comprises two opposing edges, each of the opposing edges being at least one of serrated and provided with spikes.

84. The application member of claim 68, wherein the at least one support element comprises a plurality of edges, the edges comprising at least some of the plurality of application elements for applying product, and wherein the edges at least partially define an envelope surface interconnecting the first and second portions of the application member and bearing thereagainst.

85. The application member of claim 68, wherein the first and second portions of the application member comprise front and rear portions respectively.

86. The application member of claim 85, wherein the front and rear portions are shaped so as to make it easier to pass the application member through a wiper.

87. The application member of claim 68, wherein the at least one support element comprises a zigzag configuration.

88. The application member of claim 87, wherein a longitudinal axis of the at least one support element is substantially parallel to a plane defined by the base portion.

89. The application member of claim 87, wherein the at least one support elements extends on either side of a plane, the at least one support element comprising teeth located alternately on opposing sides of the plane.

90. The application member of claim 68, wherein the at least one support element comprises a plurality of walls disposed in a flared configuration when the application member is viewed in cross-section, each of the walls comprising at least one edge configured to comb hairs.

91. The application member of claim 90, wherein the plurality of walls are configured to enable a hair to come into contact with two adjacent edges of the walls simultaneously during application.

92. The application member of claim 68, wherein the at least one support element comprises a core and a plurality of leaves supported by the core, the leaves being oriented transversely to the core.

93. The application member of claim 92, wherein the leaves overlap when the application member is viewed from a side, so as to form V-shaped notches.

94. The application member of claim 92, wherein a size of the leaves varies along the core.

95. The application member of claim 92, wherein a profile of the leaves substantially corresponds to an outline of an eyelid.

96. The application member of claim 68, wherein the at least one support element comprises a wall extending obliquely over the base portion.

97. The application member of claim 68, wherein the first portion defines a first plane and the second portion defines a second plane, the first and second planes being substantially parallel to one another.

98. The application member of claim 97, wherein the base portion defines a third plane, the first and second planes being substantially perpendicular to the third plane.

99. The application member of claim 68, wherein the first part of the at least one support element is at least one of serrated and provided with spikes.

100. The application member of claim 68, wherein the at least one support element is substantially planar in shape.

101. The application member of claim 68, wherein a longitudinal axis of the at least one support element is substantially parallel to a plane defined by the base portion.

102. An application member for applying a product to hair, the application member comprising:

a first portion;

a second portion;

a base portion interconnecting the first and second portions, the base portion comprising an end piece configured to be inserted into a wand;

a plurality of application elements configured to apply the product, the plurality of application elements being located between the first and second portions; and at least one support element located between the first and second portions, the at least one support element comprising at least some of the plurality of application elements and being connected to the base portion over no more than a portion of a length of the support element.

* * * * *

UNITED STATES PATENT AND TRADEMARK OFFICE

CERTIFICATE OF CORRECTION

PATENT NO. : 6,814,084 B2
DATED : November 9, 2004
INVENTOR(S) : Jean-Louis H. Gueret It is certified that error appears in the above-identified patent and that said Letters Patent is hereby corrected as shown below:

Column 13,
Line 28, change “contacted” to -- contained --.

Column 15,
Line 59, before “application”, insert -- the --.

Column 16,
Line 11, change “and portion;” to -- portion; and --.
Lines 40 and 43, change “claim 50,” to -- claim 52, --.

Column 18,
Line 52, after “least”, insert -- one --.

Column 19,
Line 42, change “elements” to -- element --.

Signed and Sealed this

Fifteenth Day of March, 2005

JON W. DUDAS
*Director of the United States Patent and Trademark Office*